US005465889A

United States Patent [19]

Smith

[11] Patent Number: 5,465,889

[45] Date of Patent: Nov. 14, 1995

[54] PURSE ASSEMBLY

[76] Inventor: Abram W. Smith, 40825 Avenida Califa, Palm Desert, Calif. 92260

[21] Appl. No.: 297,011

[22] Filed: Aug. 29, 1994

Related U.S. Application Data

[63] Continuation of Ser. No. 85,726, Jul. 6, 1993, abandoned.

[51] Int. Cl.[6] ..... A45F 3/00

[52] U.S. Cl. ..... 224/224; 224/226; 224/228; 224/235; 224/236

[58] Field of Search ..... 224/224, 226, 224/228, 235, 236, 237, 238, 234, 240, 911, 912, 192, 193, 191, 194, 195, 197, 198, 199, 232, 234, 235, 236, 248, 253, 904

[56] References Cited

U.S. PATENT DOCUMENTS 4,000,769 1/1977 Katz ..... 206/316.2

5,334,145 8/1993 Padin ..... 229/182

FOREIGN PATENT DOCUMENTS 107318 5/1943 Germany ..... 224/911

*Primary Examiner*—Henry J. Recla
*Assistant Examiner*—David J. Walczak
*Attorney, Agent, or Firm*—Robert J. Schaap

[57] ABSTRACT

A purse of the type adapted to be slung over the hip in the form of a gun holster. Furthermore, the purse has a size and shape somewhat similar to a western-style gun holster. In a preferred embodiment, the purse is provided with a belt of the type enabling the holster to be slung low over a hip of the wearer to provide a western-style appearance. The purse may be subdivided into individual compartments for storage of specific items.

10 Claims, 4 Drawing Sheets

PURSE ASSEMBLY

This is a continuation of Ser. No. 08/085,726, filed on Jul. 6, 1993, now abandoned.

BACKGROUND OF THE INVENTION

1. Field of the Invention

This invention relates in general to certain new and useful improvements in purses, and more particularly, to purse assemblies of the type which can be worn so as to be slung over the hip on the side of a wearer.

2. Brief Description of the Prior Art

Women typically carry purses of various sizes by slinging a shoulder strap connected to the purse over their shoulder. In many cases, purses, which are often referred to as "pocketbooks", are provided only with a small leather strap for hand carrying. However, there is no commercially available purse which is highly attractive and can be worn on a wearer's waist belt, or which can be worn about the waist on an auxiliary belt.

In addition, and in recent years, there has been a periodic trend toward the wearing of western-style clothing. Here, again, many of the women's clothing articles have been designed to conform to these current trends, so as to provide a western-style appearance, that is, so the woman appears as somewhat of a "cowgirl." Nevertheless, there have been no purse designs which conform to that mode of dress.

In addition to the foregoing, and in recent years, men have started using purses for the carrying of wallets, credit cards, checkbooks and like personal items. In some cases, these men's purses which are generally made of a leather material are designed for suspension from the belt of a man. Moreover, and as a matter of convenience, they are sometimes suspended from the belt at the wearer's side.

OBJECTS OF THE INVENTION

It is, therefore, one of the primary objects of the present invention to provide a purse assembly of the type which can be slung over a wearer's hip, much in the same manner as a gun holster is worn.

It is another object of the present invention to provide a purse assembly which includes a purse and a belt therefor enabling the belt to be worn about the wearer's waist and permitting the purse to be slung low over the wearer's hip.

It is another object of the present invention to provide a purse assembly which conforms to a western-style mode of dress but which is nevertheless highly attractive and functional in use.

It is a further object of the present invention to provide a purse assembly of the type stated which is highly effective for wear by both men and women.

With the above and other objects in view, my invention resides in the novel features of form, construction, arrangement and combination of parts presently described and pointed out in the claims.

BRIEF SUMMARY OF THE DISCLOSURE

The present invention relates in general terms to a purse of the type which resembles a gun holster and which is adapted to be worn, so that it is disposed over a wearer's hip region at the wearer's side.

In a preferred embodiment, the purse forms part of a purse assembly which is provided with a belt, such that the belt can be worn around a wearer's waist and permitting the end having the purse suspended therefrom to be slung low so that it fits adjacent the side of a wearer's body in the hip region. In this way, the purse will assume somewhat of an appearance of a gun holster.

The purse of the invention is preferably constructed of a leather material, although other materials may be employed. Furthermore, it has a shape and overall size somewhat approximating that of a conventional handgun holster. The purse may be constructed with numerous decorative materials on the surface thereof so as to provide either a more basic appearance or a more dressy appearance.

The purse is constructed of an outer casing or housing which is somewhat trapezoidal in shape in front elevational view thereof. The upper end of the housing is initially opened and covered by a flap which is connected to, or otherwise integral with the rear wall of the housing. In this way, the flap is removably disposed over the opening.

The housing may be subdivided internally by means of one or more partitions which are sewn or otherwise secured to the wall forming the outer housing. In this way, the housing may be subdivided into a wallet compartment, an eyeglass compartment, a coin compartment, etc. In a preferred embodiment, a vertical partition divides the housing into a rearwardly disposed wallet compartment and a forwardly disposed eyeglass compartment. The partition terminates by merging into the outwardly disposed or front wall of the housing, thereby permitting access to a lower coin compartment.

This invention has many other objects and purposes which will be made more clearly apparent from a consideration of the forms in which it may be embodied. One of these forms is more fully illustrated in the accompanying drawings and described in the following detailed description. However, it should be understood that this detailed description and the accompanying drawings are set forth for purposes of illustrating the general principles of the invention and are not to be taken in a limiting sense.

BRIEF DESCRIPTION OF THE DRAWINGS

Figure 1:
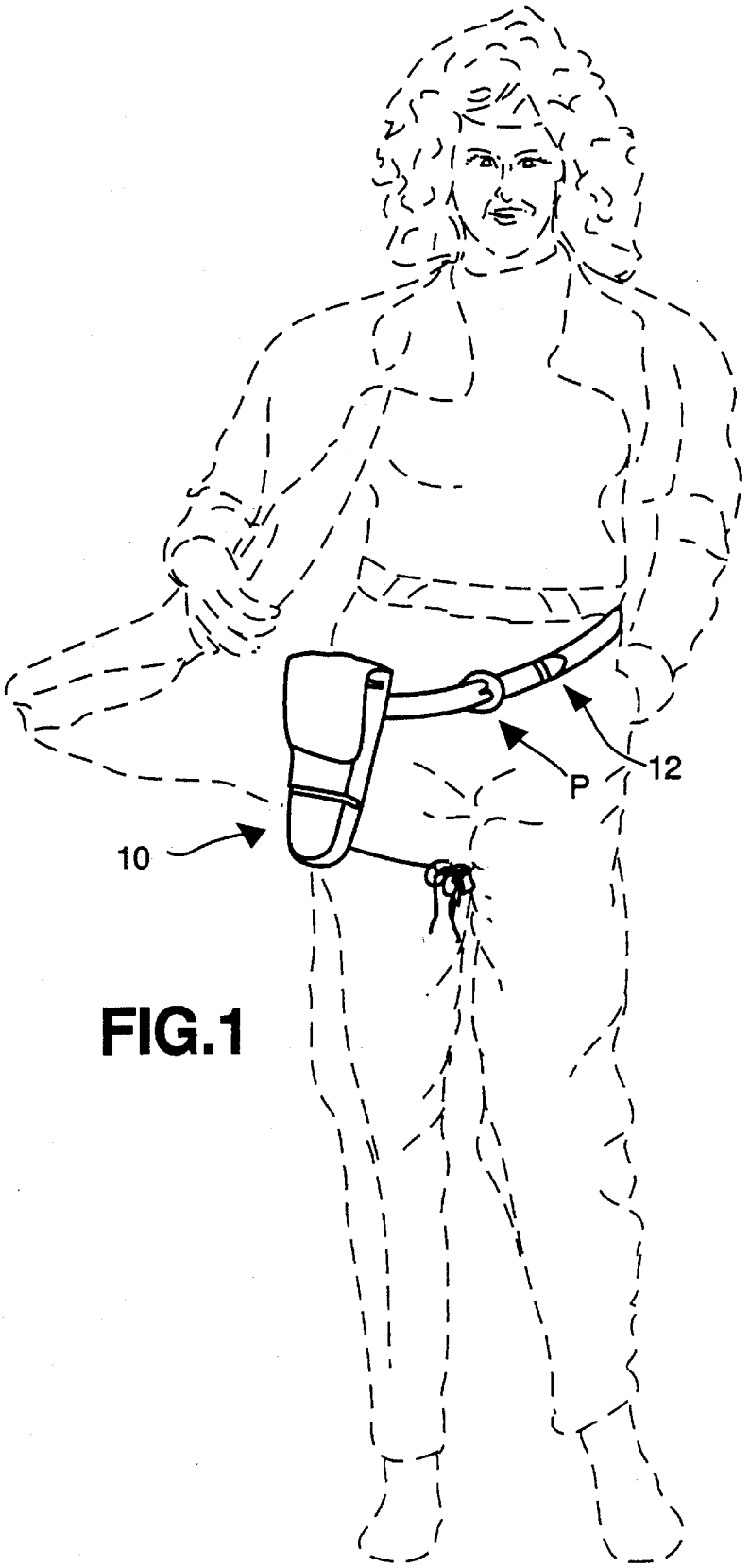
Figure 2:
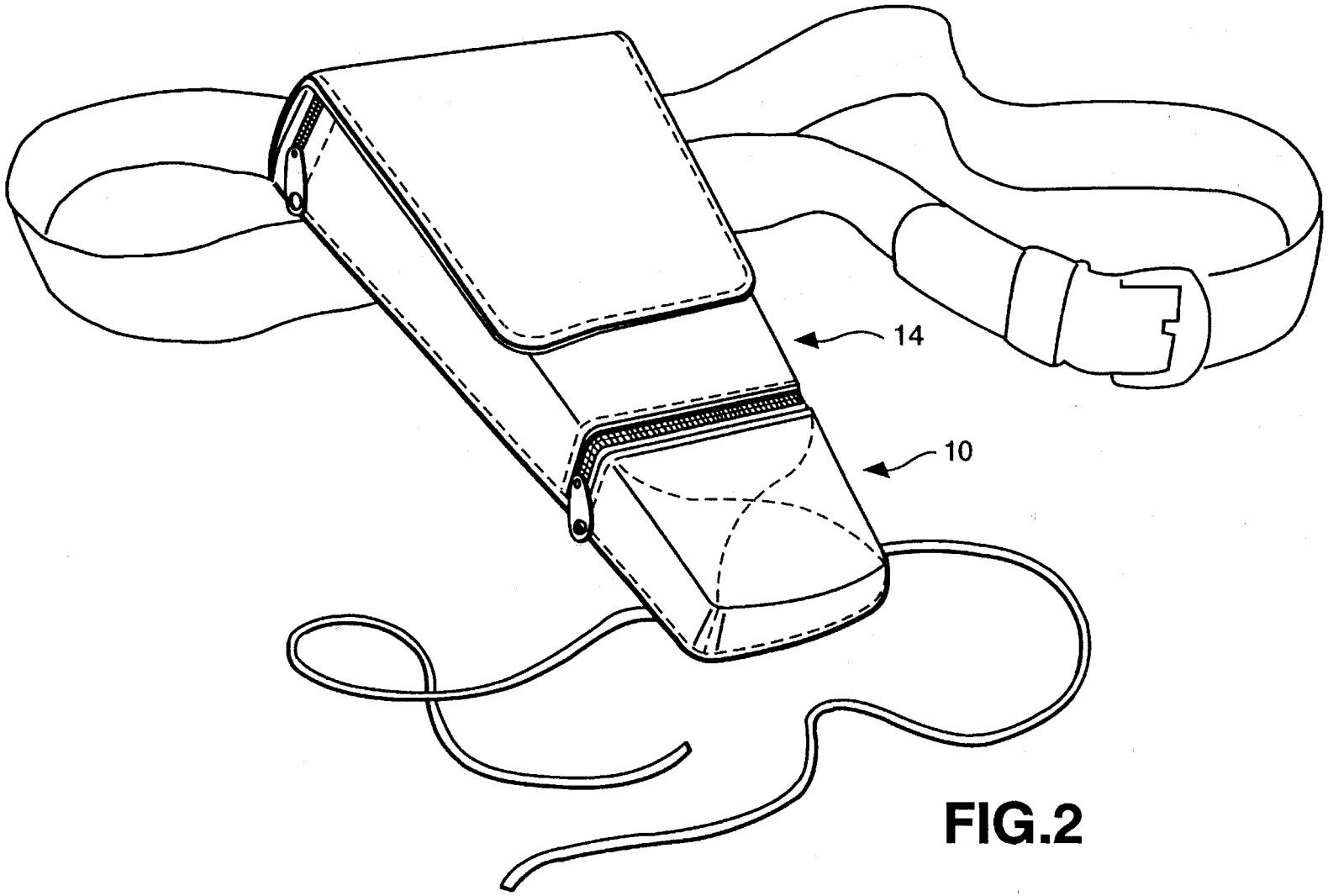
Figure 3:
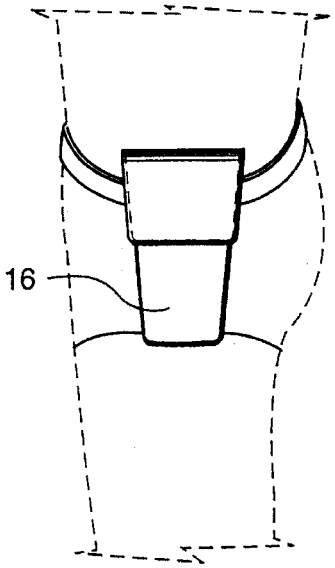
Figure 4:
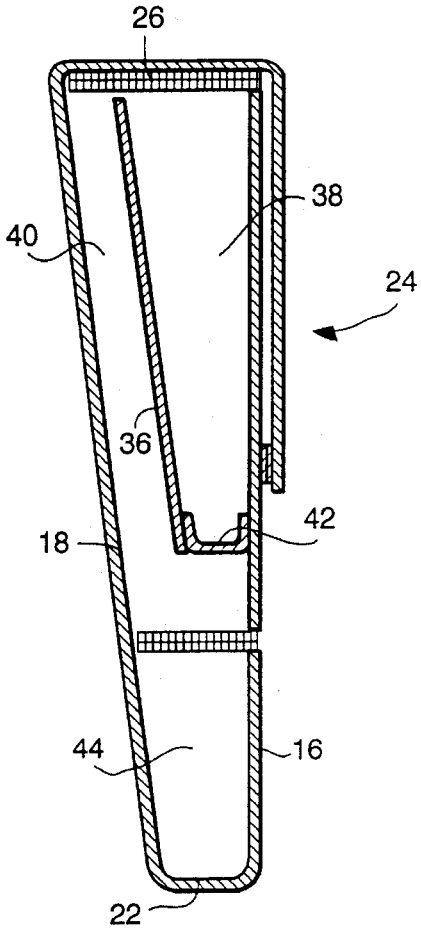
Figure 5:
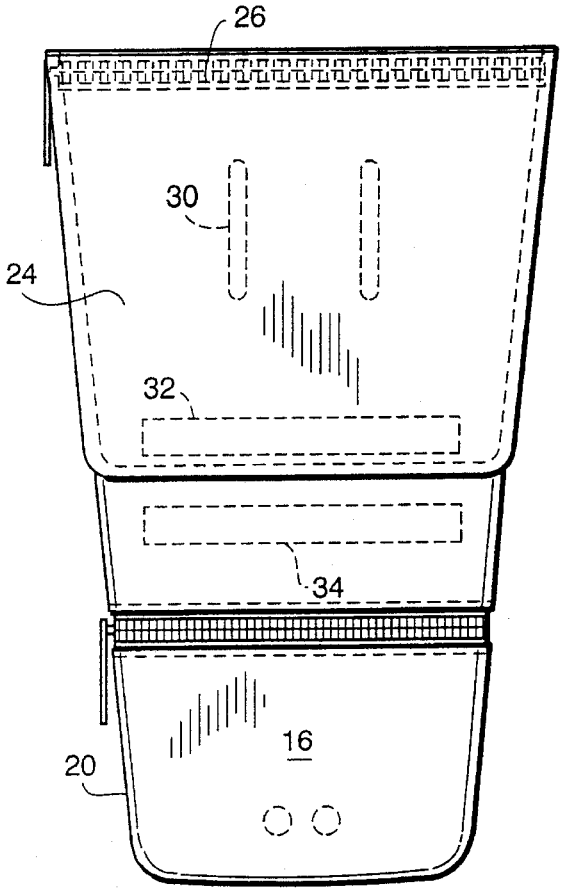
Figure 6:
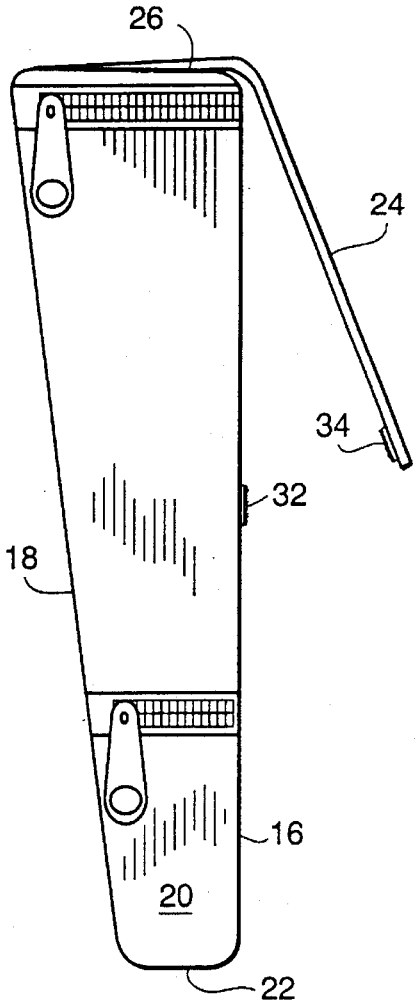
Figure 7:
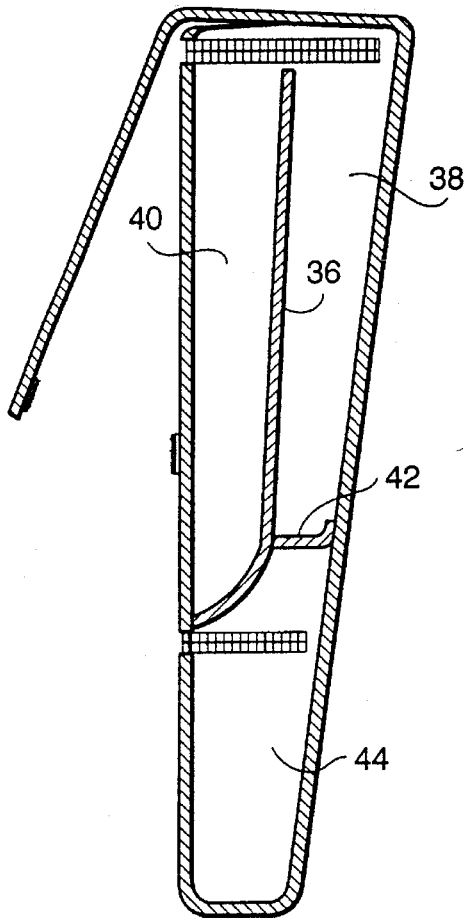

Having thus described the invention in general terms, references will now be made to the accompanying drawings in which:

FIG. 1 is a schematic perspective view showing the purse assembly, constructed in accordance with the present invention, being worn on the woman;

FIG. 2 is perspective view of the purse assembly constructed in accordance with and embodying the present invention;

FIG. 3 is a front elevational view of the purse assembly in a position as being worn on the body of a user;

FIG. 4 is a side elevational view of the purse forming part of the assembly and showing a portion of the interior thereof in dotted lines;

FIG. 5 is a front elevational view of the purse forming part of the assembly and also showing a portion of the interior thereof in dotted lines;

FIG. 6 is an end elevational view of the purse forming part of the assembly; and FIG. 7 is a vertical sectional view taken along an end of another embodiment of the purse assembly.

DETAILED DESCRIPTION OF PREFERRED EMBODIMENTS

Referring now in more detail and by reference characters to the drawings, P designates a purse assembly comprised of a purse 10 and a belt 12. Referring to FIG. 1, it can be seen that the belt has one side disposed about the waist of a woman's body with the other side slung somewhat lower and over a hip region at the side of the woman's body. The purse is connected to the belt so that it is worn in a position approximating the position of a gun holster, all as best seen in FIG. 1 of the drawings.

A tie 13 is provided at the lower end of the purse for extending about and tying the holster purse at its lower end to the leg of a user, much in the same manner as a gun holster is tied to a user's leg.

In connection with the present invention, it can be observed that the purse assembly is being described and illustrated as worn by a woman. In most cases, the purse assembly will be worn by women. However, the invention is not so limited in that many men will also find the purse assembly highly effective for use. Thus, and in this context, even though the invention is described and illustrated in connection with use by women, it should be understood that it is also highly effective for use by men.

Referring now in more detail to FIGS. 2 through 5 of the drawings, it can be seen that the purse 10 comprises an outer housing 14 having a front wall 16, a rearwardly facing or hip-engaging wall 18, a pair of lateral side walls 20 and a bottom wall 22. A flap 24 is integral with the rear wall 18 and extends over an initially open top 26 which initially provides access to the interior of the housing. By further reference to FIGS. 2, 3, and 4, it can be seen that the flap 24 extends over the initially open top 26 and engages a portion of the flat front wall 16.

By further reference to FIGS. 2, 3, and 5, it can be seen that in elevational view, the purse housing is actually somewhat trapezoidal in shape, such that the opening 26 at the top has a greater length and width than the bottom wall 22.

The rearward wall 18 is actually somewhat inclined, as best shown in FIG. 4, when the purse housing is generally vertically arranged, as illustrated in FIGS. 4 and 5. This type of construction allows the purse housing to lie flat against the hip of the user when the hip bones may be slightly protruding and to also accommodate for potential excess weight in the hip region of the user.

The belt 12 is secured to the outer housing 14 by any conventional means, although a pair of slots 30 formed in the back wall to receive the belt 12 are preferred. In this case, the belt 12 is merely trained through the slots 30 and is retained therein by somewhat of a friction fitting with the material forming the housing. At its lower end, the holster purse is provided with a tie which extends about and is tied about the leg of the user.

Any conventional means may also be provided for securing the flap 24 to the front wall 16. In the embodiment, as illustrated, fiber-fastening attachment straps 32 and 34 are provided. In this case, one strap 34 may be secured to the front wall 16 of the outer housing 14 and the other strap 34 may be secured to the interiorly presented face of the flap 24. However, suitable releasible adhesive strips and the like could also be employed. As indicated, any conventional means for releasably attaching the flap 24 in order to obtain immediate access to the interior of the purse 10 could be provided for this purpose.

The outer housing 14 is internally divided by means of a somewhat vertically arranged partition 36 and which forms an interior wallet containing compartment 38 and an interior eyeglass receiving compartment 40. Furthermore, the vertical partition 36 may also be provided with a horizontally struck tab 42 connected to the front wall 16 in the manner as illustrated in FIGS. 4 and 6 of the drawings. In this way, a lower coin compartment 44 is provided. Access to this coin compartment 44 is maintained through a zippered opening 46. Furthermore, FIG. 7 shows a slightly different embodiment wherein partition 36' and tab 42' are arranged within housing 14 in order to give the purse 10 a different internal pocket configuration than the embodiment shown in FIG. 4.

Although the purse 10 has been illustrated as having been divided into three individual compartments, it should be understood that other partitions could be provided and that the purse could be divided into any desired number of compartments, the only constraint being the overall size of the purse.

Thus, there has been illustrated and described a unique and novel purse assembly and a particular purse which fits a western-style motif for use by a women and men. The purse, therefore, fulfills all of the objects and advantages which have been sought. It should be understood that many changes, modifications, variations and other uses and applications will be encompassed by the invention without departing from the nature and spirit of the invention. Therefore, any and all such changes, modifications, variations and other uses and applications which do not depart from the spirit and scope of the invention are deemed to be covered by the invention.

Having thus described the invention, what I desire to claim and secure by letters patent is:

1. A purse assembly adapted to provide a simulated appearance of a gun holster and thereby provide a western-style dress motif to the wearer, said purse assembly comprising:

a) a belt adapted to be worn at least partially about the waist of the wearer, and slung downwardly at one lateral side of the wearer so that the belt is hung below the waist of the wearer at this lateral side and at the hip region of the wearer at this lateral side;

b) a purse connected to said belt and adapted to be worn adjacent to the hip of the wearer at the side of the wearer, said purse having front and rear walls and connecting side walls forming an interior of the purse, each of said front and rear walls and each of said side walls being trapezoidal in shape and being tapered progressively downwardly so that the front and rear walls and the side walls of the purse appear generally trapezoidal in shape both in front elevation and side elevation, thereby providing an appearance of a gun holster although functioning as a purse and being sized for the holding of women's or men's accessory articles which are not firearms;

c) an interior vertically arranged partition dividing the interior of the purse into first and second compartments for the storage of articles;

d) means for providing an access to the interior compartments of said purse for storage of the personal articles of the wearer;

e) closure means for closing and opening the purse to obtain an access to the interior compartments and which closure means is openable and closable at the option of the wearer; and f) said purse having an outer appearance and shape similar to that of a revolver type hand gun holster and being adapted to be slung over the hip of the wearer at the lateral side of the wearer, much in the same manner as a gun slinger would wear a gun holster to thereby aid in the simulation of the wearer appearing as a gun slinger although the purse contains only non-firearms accessories.

2. A purse assembly of claim 1 further characterized in that a somewhat horizontally disposed partition section further divides the purse into an additional compartment with means providing access to that additional compartment.

3. The purse assembly of claim 1 further characterized in that said purse is comprised of an upper opening with a flap extendable over said opening and being removable with respect to said opening to provide access to the interior compartment of the purse and which is closable so as to block access to the interior compartments.

4. The purse assembly of claim 1 further characterized in that said purse is provided with an interior pocket accessible from an elongate generally horizontal slot in said first wall and locking means openable on said front wall to permit opening and closing of said elongate slot.

5. The purse assembly of claim 4 further characterized in that said locking means is a zipper.

6. A purse assembly adapted to provide a simulated appearance of a gun holster and thereby provide a western-style dress motif to the wearer, said purse assembly comprising:

a) a belt adapted to be worn at least partially about the waist of the wearer, and slung downwardly at one lateral side of the wearer so that the belt is hung below the waist of the wearer at this lateral side and at the hip region of the wearer at this lateral side;

b) a purse connected to said belt and adapted to be worn adjacent to the hip of the wearer at the side of the wearer, said purse having front and rear walls and connecting side walls which extend between the front and rear walls, each of said front and rear walls and said side walls also having upper ends and lower ends, the front and rear walls being tapered progressively downwardly so that the width of the front and rear walls becomes progressively smaller from the upper ends to the lower ends and so that they have a width which is more narrow at the lower ends than at the upper ends, said side walls also being tapered progressively downwardly so that the width of the side walls becomes progressively smaller from the upper ends to the lower ends so that they also have a width which is more narrow at their lower ends than their upper ends, such that the purse is generally trapezoidal, thereby providing an appearance of a gun holster although functioning as a purse and being sized for the holding of women's or men's accessory articles which are not firearms;

c) means permanently closing the lower ends of said front and rear walls and said side walls forming an interior of the purse;

d) an interior vertically arranged partition dividing the interior of the purse into first and second compartments for the storage of articles;

e) means for providing an access to the interior compartments of said purse for storage of the personal articles of the wearer;

f) closure means for closing and opening the purse to obtain an access to the interior compartments and which closure means is openable and closable at the option of the wearer; and g) said purse having an outer appearance and shape similar to that of a revolver type hand gun holster and being adapted to be slung over the hip of the wearer at the lateral side of the wearer, much in the same manner as a gun slinger would wear a gun holster to thereby aid in the simulation of the wearer appearing as a gun slinger although the purse contains only non-firearms accessories.

7. The purse assembly of claim 6 further characterized in that a somewhat horizontally disposed partition section further divides the purse into an additional compartment with means providing access to that additional compartment.

8. The purse assembly of claim 6 further characterized in that said purse is comprised of an upper opening with a flap extendable over said opening and being removable with respect to said opening to provide access to the interior compartments of the purse and which is closable so as to block access to the interior compartments.

9. The purse assembly of claim 9 further characterized in that said purse is provided with an interior pocket accessible from an elongate generally horizonal slot in said front wall, and locking means operable on said front wall to permit opening and closing of said elongate slot.

10. The purse assembly of claim 9 further characterized in that said locking means is a zipper.

* * * * *